US006178795B1

(12) United States Patent
Hsueh

(10) Patent No.: US 6,178,795 B1
(45) Date of Patent: Jan. 30, 2001

(54) LOCKABLE STRUCTURE FOR A BIG-HANDLE LOCK

(75) Inventor: Chiang-Lin Hsueh, Kaohsiung Hsein (TW)

(73) Assignee: Taiwan Fu Hsing Industrial Co., Ltd., Kaohsiung Hsien (TW)

( * ) Notice: Under 35 U.S.C. 154(b), the term of this patent shall be extended for 0 days.

(21) Appl. No.: 09/520,957

(22) Filed: Mar. 8, 2000

(51) Int. Cl.[7] ..... E05B 13/00

(52) U.S. Cl. ..... 70/472; 70/149; 70/218; 292/172; 292/DIG. 27

(58) Field of Search ..... 70/149, 218, 422, 70/472, DIG. 42; 292/142, 172, DIG. 27, DIG. 62

(56) References Cited

U.S. PATENT DOCUMENTS 2,266,106 * 12/1941 Voight et al. ..... 70/DIG. 42 X
4,052,092 * 10/1977 Bergen ..... 292/172
4,725,085 * 2/1988 Hu et al. ..... 292/172
5,060,991 * 10/1991 Davidian et al. ..... 292/DIG. 27 X
5,123,683 * 6/1992 Solovieff ..... 292/172
5,513,510 * 5/1996 Solovieff et al. ..... 70/472
5,570,916 * 11/1996 Mader ..... 70/422 X
5,611,227 * 3/1997 Solovieff ..... 292/DIG. 27 X

FOREIGN PATENT DOCUMENTS 122820 11/1989 (TW) .

* cited by examiner

*Primary Examiner*—Lloyd A. Gall
(74) *Attorney, Agent, or Firm*—Bacon & Thomas, PLLC

(57) ABSTRACT

A lockable structure for a big-handle lock includes a base plate for connection with a bottom plate and a cover plate. A lock core assembly is mounted between the base plate and the cover plate. A transmission assembly is mounted between the base plate and a bottom plate. The lock core of the lock core assembly and a turn-button of an inner handle may drive a locking bar around which a follower disc is mounted. The follower disc includes a cam for driving a control plate. The control plate includes a projection for releasably engaging with a groove of a press-plate. Thus, when a press member is pressed, the press-plate, the control plate, and the actuating plate are moved accordingly. The actuating plate includes a rack portion for meshing with a transmission wheel for turning a spindle, thereby controlling retraction of a latch bolt.

8 Claims, 6 Drawing Sheets

LOCKABLE STRUCTURE FOR A BIG-HANDLE LOCK

BACKGROUND OF THE INVENTION

1. Field of the Invention

The present invention relates to a lockable structure for a big-handle lock.

2. Description of the Related Art

Taiwan Utility Model Publication No. 122820 issued on Nov. 11, 1989 and entitled "TRANSMISSION MECHANISM FOR A BIG-HANDLE LOCK" discloses a so-called big-handle lock comprising a seat assembly and a transmission assembly. The seat assembly includes a receiving member, a press member, and a pivotal pin. The transmission assembly includes a cover plate, a push-button rod, a connecting plate, a transmission plate, a fixing button, an actuating spring, a transmission rod, and a bottom plate. The big-handle lock is mounted to a door to allow easy opening of the door, which is particularly suitable for a heavy door. When the push-button rod is pushed, the transmission rod 26 is rotated for retracting a latch bolt to allow opening of the door. Nevertheless, the big-handle lock cannot provide locking function such that an additional lockable structure is required. As a result, installation and use of the big-handle lock and the additional lockable structure are inconvenient.

SUMMARY OF THE INVENTION

It is the primary object of the present invention to provide a lockable structure for a big-handle lock to allow easy installation and use of the big-handle lock.

A lock in accordance with the present invention comprises:

- a base plate adapted to be mounted to a door and including a first opening;
- a lock core assembly mounted to the base plate and including a lock core;
- a press member including a first end extended through the first opening and a second end for manual pressing;
- a bottom plate mounted to the base plate and including an axle hole and a second opening through which the first end of the press member extends;
- a transmission assembly comprising:
  - a transmission wheel rotatably mounted in the axle hole of the bottom plate and including a plurality of teeth;
  - an actuating plate including a rack portion for meshing with the teeth of the transmission wheel, whereby rectilinear movement of the actuating plate causes rotational movement of the transmission wheel;
  - a control plate operably connected to the actuating plate to move therewith, the control plate including a projection and a slot;
  - a press-plate including a groove for releasably engaging with the projection of the control plate, the press-plate including a hole through which the first end of the press member extends for driving the press-plate, the press-plate being moved rectilinearly when the second end of the press member is pressed;
  - a locking bar including a first end engaged with the lock core of the lock core assembly and a second end adapted to be engaged with a turn-button of an inner handle; and
  - a follower disc mounted around the locking bar to rotate therewith, the follower disc including a cam for bearing against a wall defining a portion of the slot of the control plate; and

- a cover plate engaged with the bottom plate and including a lock core hole through which a key is inserted to drive the lock core, the cover plate including a third opening through which the second end of the press member extends.

The bottom plate includes two pin-receiving holes located on two sides of the first opening, respectively. The pin-receiving holes receive a pin about which the press member pivots. The base plate includes two protrusions for restraining movement of the press-plate between the protrusions. The actuating plate of the transmission assembly includes a second slot and the control plate includes a block engaged in the second slot to allow joint movement of the actuating plate and the control plate. The second slot of the actuating plate includes a narrower section and a wider section, whereby rotational movement of the control plate causes released or fitted engagement between the second slot and the block of the control plate. An elastic means is provided for biasing the press-plate to return to a predetermined position.

In an embodiment of the invention, the follower disc includes a flange with a non-circular shape having two reduced diameter portions, and an elastic member has two ends attached to the reduced diameter portions, respectively. In an alternative embodiment of the invention, the follower disc includes a flange with two symmetric opposite straight sides, and an elastic member has two ends attached to the symmetric opposite straight sides, respectively.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
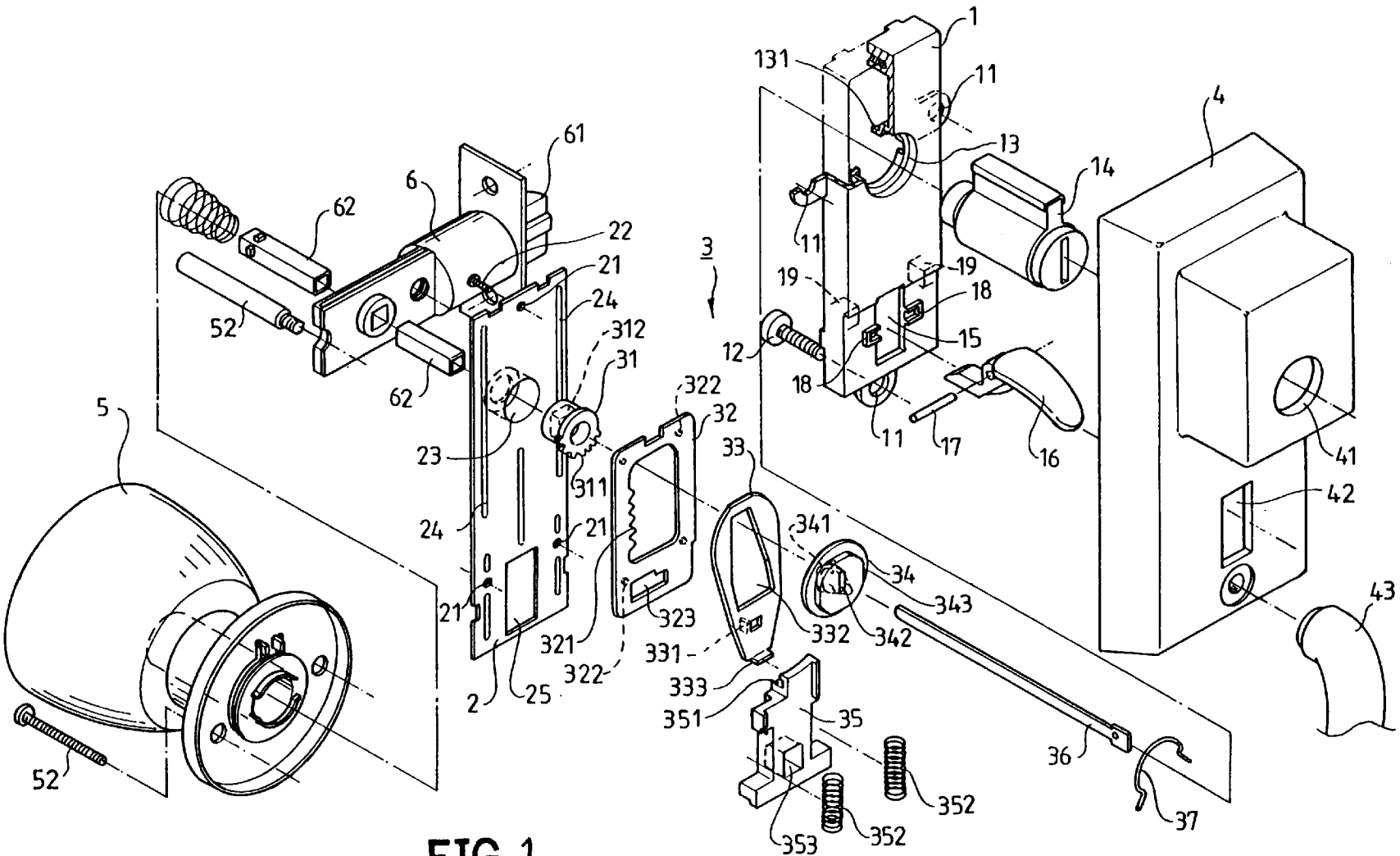
FIG. 1 is an exploded perspective view of a big-handle lock with a lockable structure in accordance with the present invention.
Figure 2:
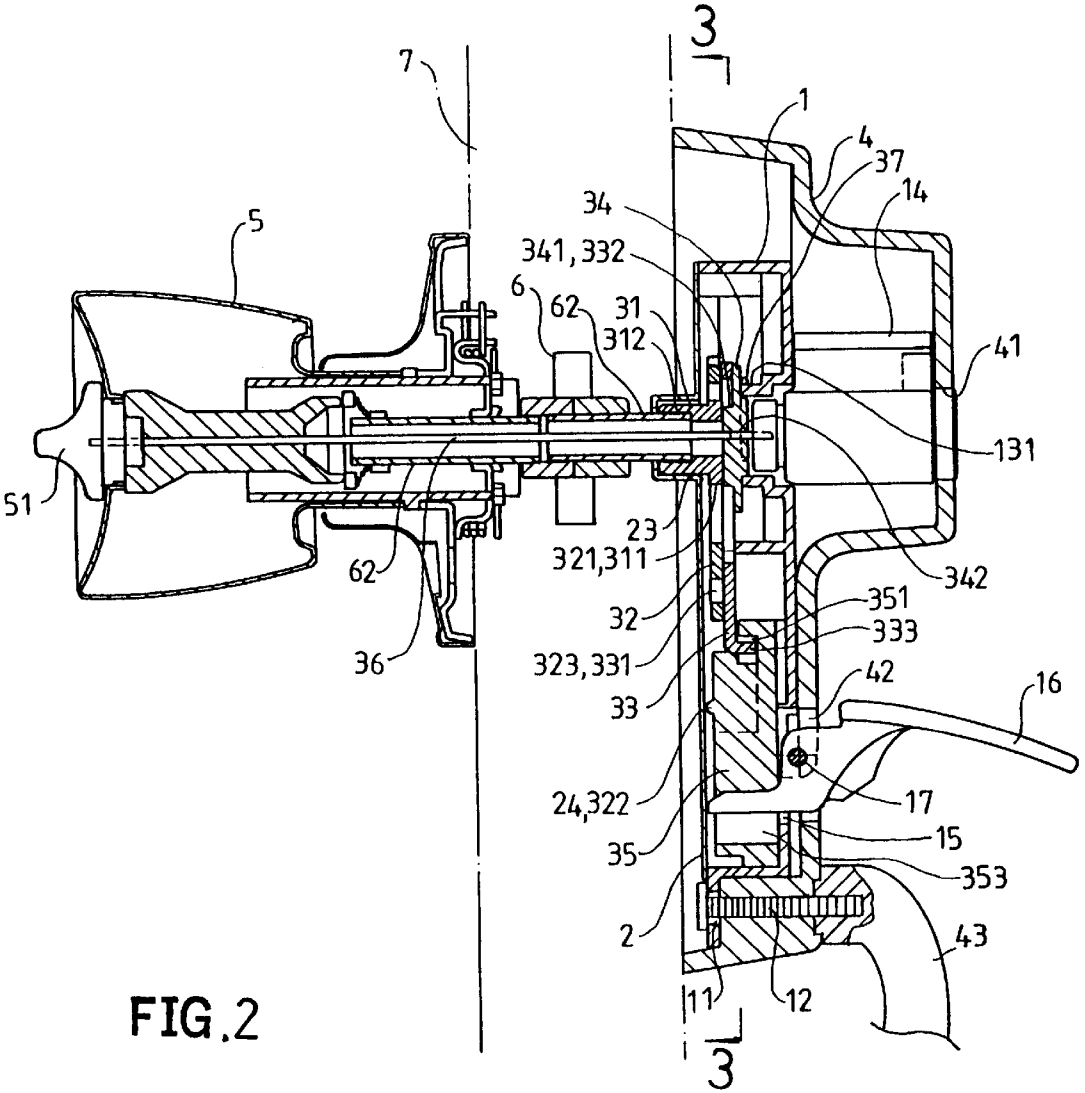
FIG. 2 is a sectional view of the big-handle lock mounted to a door.

Referring to FIGS. 1 and 2, a preferred embodiment of a lockable structure for a big-handle lock in accordance with the present invention generally includes a base plate 1, a bottom plate 2, a transmission assembly 3, and a cover plate 4. The lockable structure, when mounted to a door 7, is operably connected to an outer handle 43 (the so-called big handle) and an inner handle 5 for controlling retraction of a latch bolt 61 of a latch assembly 6 of the big-handle lock.

The base plate 1 includes a plurality of holes 11 for engaging with the cover plate 4 and the outer handle 43 by fasteners 12. A bottom of the base plate 1 is engaged with the bottom plate 2 by a fastener 22 and is fixed to the door 7 by fasteners 52. The base plate 1 includes a lock core hole 13 for receiving an end of a lock core assembly 14. The other end of the lock core assembly 14 is mounted in a lock core hole 41 in the cover plate 4. Thus, the lock core assembly 14 is positioned. The base plate 1 further includes an opening 15 through which an end of a press member 16 extends. The base plate 1 provides a support for pivotal movement of the press member 16 about a pin 17. Two ends of the pin 17 are pivotally, respectively received in two pin-receiving holes 18 located on both sides of the opening 15. The base plate 1 further includes a pair of protrusions 19 for keeping rectilinear movement of a press-plate 35.

The bottom plate 2 includes holes 21 so as to be engaged to the bottom of the base plate 1 by fastener 22. The transmission assembly 3 is mounted between the bottom plate 2 and the base plate 1. The bottom plate 2 includes an axle hole 23 for rotatably holding a transmission wheel 31. The bottom plate 2 further includes an opening 25 through which the end of the press member 16 extends. The bottom plate 2 may include ribs 24 to reinforce the structure.

The transmission assembly 3 includes the-above mentioned transmission wheel 31, an actuating plate 32, a control plate 33, a follower disc 34, the above-mentioned press-plate 35, and a locking bar 36. The transmission wheel 31 is mounted in the axle hole 23 of the bottom plate 2 and includes teeth 311 that mesh with a rack portion 321 of the actuating plate 32, thereby providing transmission therebetween. The transmission wheel 31 includes a non-circular hole 312 through which a spindle 62 of the latch transmission wheel 31 is rotated when the spindle 62 is turned.

The actuating plate 32 is mounted between the bottom plate 2 and the base plate 1 and includes knurls 322 that are in contact with the bottom plate 2 for reducing friction between the bottom plate 2 and the actuating plate 32. The actuating plate 32 includes a slot 323 through which a block 331 of the control plate 33 extends. The slot 323 includes a narrower section (not labeled) and a wider section (not labeled) such that the block 331 is engaged in the narrower section when the control plate 33 is turned, thereby providing firm engagement to allow transmission between the control plate 33 and the actuating plate 32.

The control plate 33 includes a slot 332 for receiving a cam 341 of the follower disc 34. When the follower disc 34 is turned, the control plate 33 is turned via transmission of the cam 341 and a projection 333 of the control plate 33 is moved into or out of a groove 351 of the press-plate 35.

The cam 341 of the follower disc 34 is eccentrically arranged for bearing against a side wall defining a portion of the slot 332 of the control plate 33, thereby turning the control plate 33. In order to restrain rotational movement of the follower disc 34, the follower disc 34 includes a flange 343 of a non-circular shape or having symmetric opposite straight sides. An elastic member 37 is attached to the reduced diameter portions of the non-circular shape or flat symmetric opposite straight sides of the flange 343. Thus, the follower disc 34 is rotatable and can be stopped at a predetermined position. The elastic member 37 is mounted to an inner side of an annular ledge 131 formed in the lock core assembly hole 13.

The press-plate 35 is mounted between the protrusions 19 of the base plate 1 and biased by elastic elements 352 downward to a predetermined position. The above-mentioned groove 351 of press-plate 35 releasably receives the projection 333 of the control plate 33. The press-plate 35 further includes a hole 353 through which the end of the press member 16 extends. When the press member 16 is pressed, the press-plate 35 is moved upward. If the projection 333 of the control plate 33 is engaged in the groove 351 of the press-plate 35, the control plate 33 is moved upward.

The locking bar 36 has a non-circular section and includes an end for engaging with the lock core (not labeled) of the lock core assembly 14. The other end of the locking bar 36 is connected to a turn-button 51 of the inner handle 5. The follower disc 34 is mounted around the locking bar 36 such that the locking bar 36 is turned to thereby turn the follower disc 34 for providing a locking function when either the lock core of the lock core assembly 14 or the turn-button 51 is turned.

The cover plate 4 is mounted to an outer side of the base plate 1 to provide an aesthetically pleasing appearance. The cover plate 4 is engaged with the outer handle 43 to allow easy pivotal movement of the door 7. The other end of the lock core assembly 14 is mounted in the lock core hole 41 in the cover plate 4 through which a key (not shown) is insertable. The cover plate 4 further includes an opening 42 beyond which the other end of the press member 16 extends for manual operation.

Figure 4:
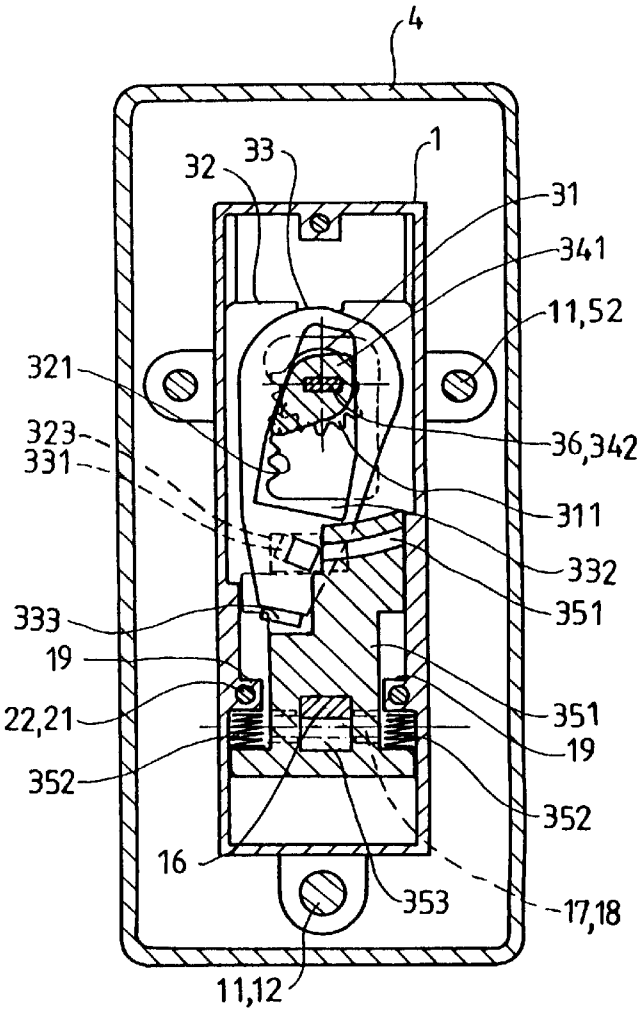
FIG. 4 is a sectional view similar to FIG. 3, illustrating operation of the big-handle lock in a locked status.
Figure 3:
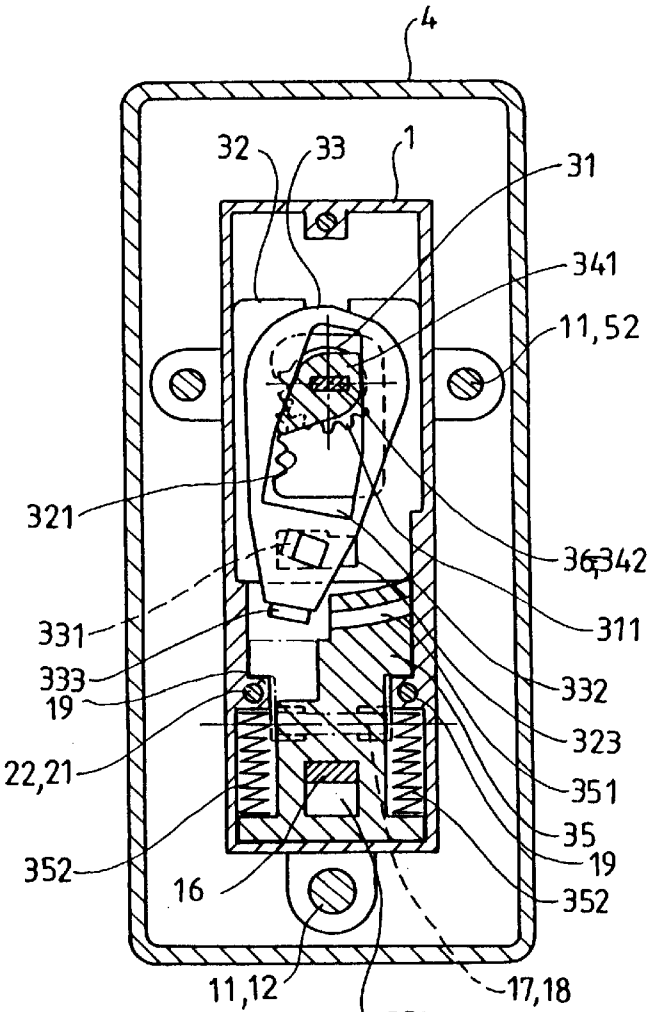
FIG. 3 is a sectional view taken along line 3—3 in FIG. 2.

FIGS. 2 and 3 show the locked status of the lock which can be obtained by means of turning the turn-button 51 or operating a key for the lock core of the lock core assembly 14. The locking bar 36 is turned to rotate the follower disc 34. The cam 341 of the follower disc 34 urges the control plate 33 to turn to thereby make the projection 333 of the control plate 33 disengage from the groove 351 of the press-plate 35. As a result, when the press member 16 outside the door 7 is pressed, the press-plate 35 is moved upward (FIG. 4), yet the control plate 33 cannot be moved upward, since the projection 333 of the control plate 33 is disengaged from the groove 351 of the press-plate 35. Accordingly, the pressing of the press member 16 is a virtual work.

Figure 5:
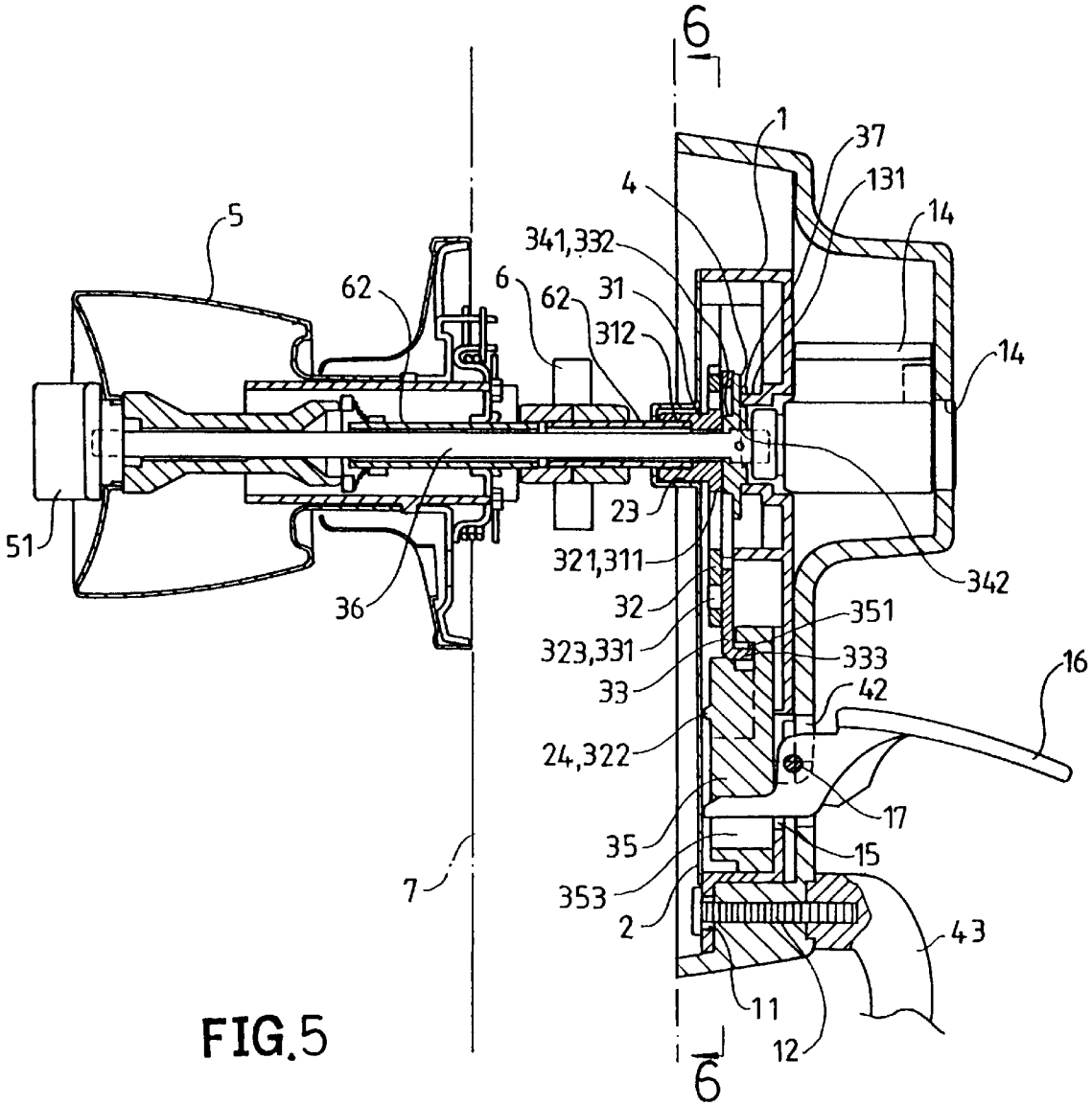
FIG. 5 is a sectional view similar to FIG. 3, wherein the big-handle lock is in an unlocked status.
Figure 7:
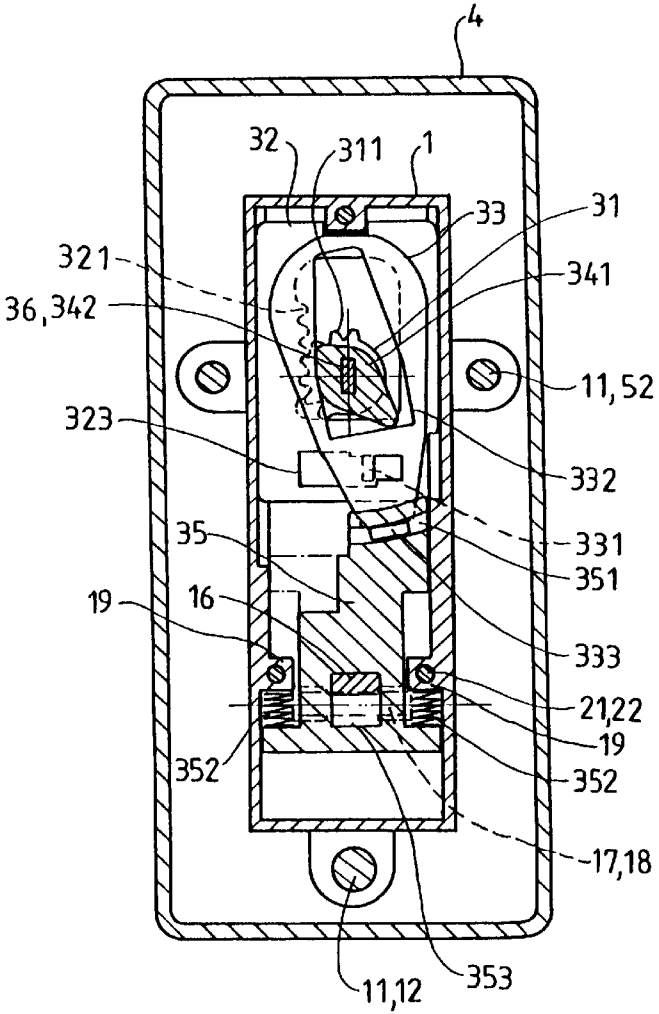
FIG. 7 is a sectional view similar to FIG. 6, illustrating unlatching operation of the big-handle lock by means of pressing a press member.
Figure 6:
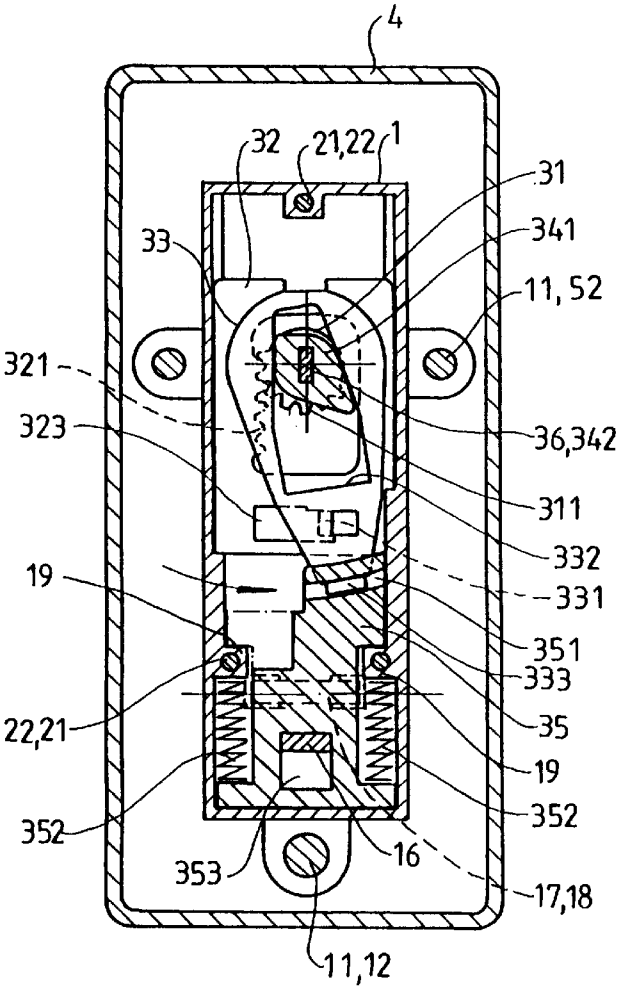
FIG. 6 is a sectional view taken along line 6—6 in FIG. 5.

FIGS. 5 and 6 show the lock in an unlocked status that can be obtained by means of turning the turn-button 51 or operating a key for the lock core of the lock core assembly 14. The locking bar 36 is turned to rotate the follower disc 34. The cam 341 of the follower disc 34 urges the control plate 33 to turn to thereby make the projection 333 of the control plate 33 engage with the groove 351 of the press-plate 35. As a result, when the press member 16 outside the door 7 is pressed (FIG. 7), the press-plate 35 is moved upward, and the control plate 33 is also moved upward, since the projection 333 of the control plate 33 is engaged with the groove 351 of the press-plate 35. Thus, the actuating plate 33 is moved upward via transmission of the block 331 of the control plate 33. The transmission wheel 31 is turned via transmission of the rack portion 321 of the actuating plate 32 and the teeth 311 of the transmission wheel 31. The spindle 62 is turned, as it is engaged in the non-circular hole 312 of the transmission wheel 31. As a result, the latch bolt 61 of the latch assembly 6 is retracted, thereby allowing opening of the door 7.

Figure 8:
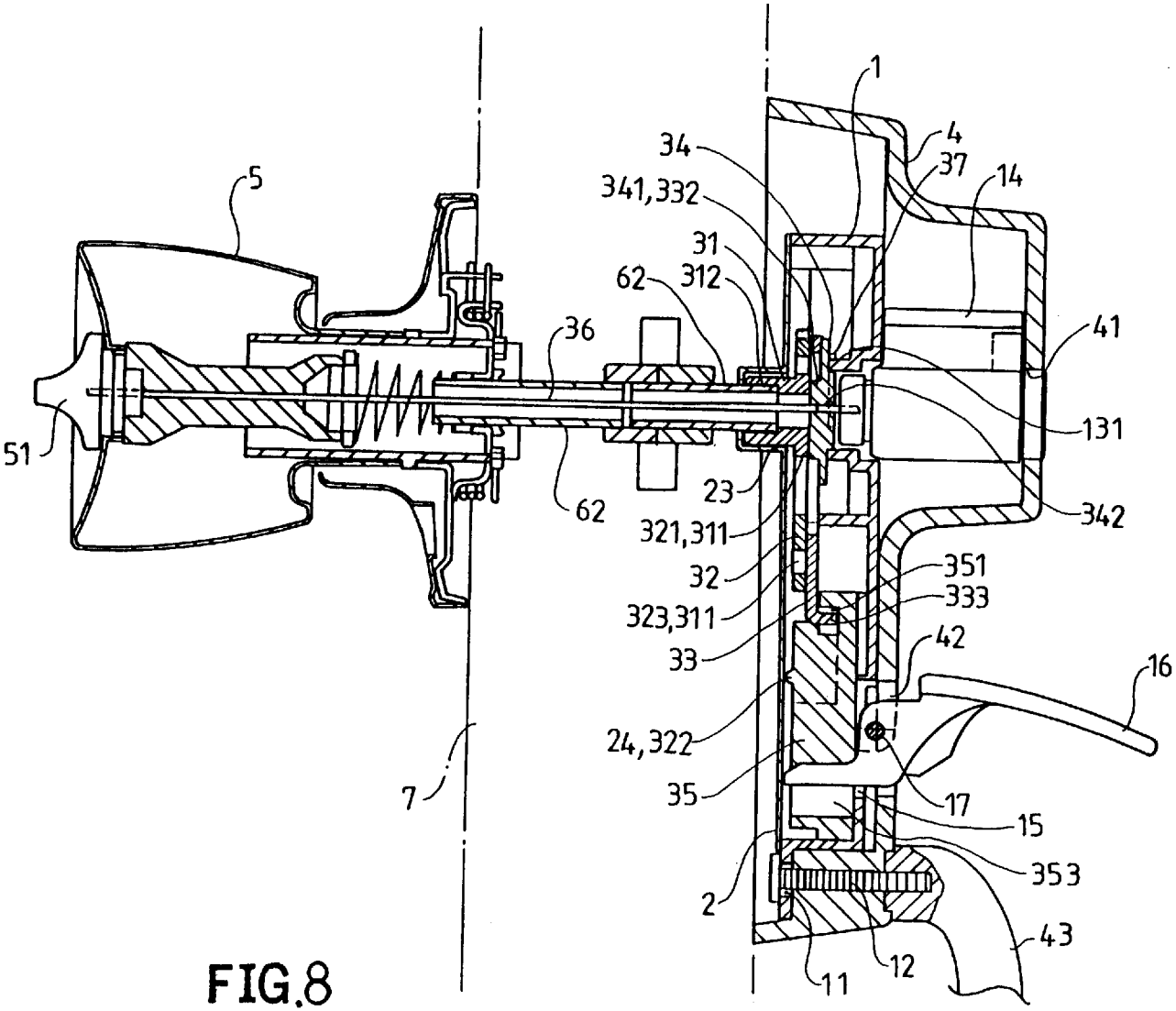
FIG. 8 is a sectional view similar to FIG. 2, wherein the big-handle lock is mounted to a thicker door.

FIG. 8 illustrates application of the lock in accordance with the present invention to a thicker door.

Accordingly, the big-handle lock in accordance with the present invention provides a locking function, which is convenient to installation and use.

Although the invention has been explained in relation to its preferred embodiment as mentioned above, it is to be understood that many other possible modifications and variations can be made without departing from the spirit and scope of the invention. It is, therefore, contemplated that the appended claims will cover such modifications and variations that fall within the true scope of the invention.

What is claimed is:

1. A lock comprising:

a base plate adapted to be mounted to a door and including a first opening;

a lock core assembly mounted to the base plate and including a lock core;

a press member including a first end extended through the first opening and a second end for manual pressing;

a bottom plate mounted to the base plate and including an axle hole and a second opening through which the first end of the press member extends;

a transmission assembly comprising:

a transmission wheel rotatably mounted in the axle hole of the bottom plate and including a plurality of teeth;

an actuating plate including a rack portion for meshing with the teeth of the transmission wheel, whereby rectilinear movement of the actuating plate causes rotational movement of the transmission wheel;

a control plate operably connected to the actuating plate to move therewith, the control plate including a projection and a slot;

a press-plate including a groove for releasably engaging with the projection of the control plate, the press-plate including a hole through which the first end of the press member extends for driving the press-plate, the press-plate being moved rectilinearly when the second end of the press member is pressed;

a locking bar including a first end engaged with the lock core of the lock core assembly and a second end adapted to be engaged with a turn-button of an inner handle; and a follower disc mounted around the locking bar to rotate therewith, the follower disc including a cam for bearing against a wall defining a portion of the slot of the control plate; and a cover plate engaged with the bottom plate and including a lock core hole through which a key is inserted to drive the lock core, the cover plate including a third opening through which the second end of the press member extends.

2. The lock as claimed in claim 1, wherein the base plate includes two pin-receiving holes located on two sides of the first opening, respectively, the pin-receiving holes receiving a pin about which the press member pivots.

3. The lock as claimed in claim 1, wherein the base plate includes two protrusions for restraining movement of the press-plate between the protrusions.

4. The lock as claimed in claim 1, wherein the actuating plate of the transmission assembly includes a second slot and wherein the control plate includes a block engaged in the second slot to allow joint movement of the actuating plate and the control plate.

5. The lock as claimed in claim 4, wherein the second slot of the actuating plate includes a narrower section and a wider section, whereby rotational movement of the control plate causes released or fitted engagement between the second slot and the block of the control plate.

6. The lock as claimed in claim 1, wherein the follower disc includes a flange with a non-circular shape having two reduced diameter portions, further comprising an elastic member having two ends attached to the reduced diameter portions, respectively.

7. The lock as claimed in claim 1, wherein the follower disc includes a flange with two symmetric opposite straight sides, further comprising an elastic member having two ends attached to the symmetric opposite straight sides, respectively.

8. The lock as claimed in claim 1, further comprising an elastic means for biasing the press-plate to return to a predetermined position.

* * * * *